US007681563B2

(12) United States Patent
Idogawa et al.

(10) Patent No.: US 7,681,563 B2
(45) Date of Patent: Mar. 23, 2010

(54) IGNITION COIL APPARATUS FOR INTERNAL COMBUSTION ENGINE

(75) Inventors: Takashi Idogawa, Chiyoda-ku (JP); Takeshi Shimizu, Chiyoda-ku (JP)

(73) Assignee: Mitsubishiki Electric Corporation, Tokyo (JP)

( * ) Notice: Subject to any disclaimer, the term of this patent is extended or adjusted under 35 U.S.C. 154(b) by 0 days.

(21) Appl. No.: 11/934,130

(22) Filed: Nov. 2, 2007

(65) Prior Publication Data

US 2008/0271724 A1 Nov. 6, 2008

(30) Foreign Application Priority Data

May 1, 2007 (JP) ..... 2007-120867

(51) Int. Cl.
*H01F 38/12* (2006.01)
*H01F 38/14* (2006.01)

(52) U.S. Cl. ..... 123/634

(58) Field of Classification Search ..... 123/634, 123/635; 336/107, 105, 198, 208; 439/126, 439/127, 128, 271, 272, 125
See application file for complete search history.

(56) References Cited

U.S. PATENT DOCUMENTS 2,665,673 A * 1/1954 Woofter ..... 439/125
4,073,565 A * 2/1978 Raymond ..... 439/777
4,859,194 A * 8/1989 Bartholomew ..... 439/125
5,170,767 A * 12/1992 Wada et al. ..... 123/633
5,357,233 A * 10/1994 Wada ..... 336/107
5,781,092 A * 7/1998 Nakamichi et al. ..... 336/96
6,273,733 B1 * 8/2001 Uchiyama ..... 439/125

FOREIGN PATENT DOCUMENTS

JP 5052175 A 3/1993

* cited by examiner

*Primary Examiner*—Mahmoud Gimie
(74) *Attorney, Agent, or Firm*—Sughrue Mion, PLLC

(57) ABSTRACT

An ignition coil apparatus for an internal combustion engine can be produced at low cost with a simple structure, and can be inserted into a bent plug hole without impairing insertability thereof. The apparatus is provided with a high voltage tower (2*b*) that holds a high voltage terminal (8) in its interior, and a cylindrical plug boot (10) that has electrical insulation and flexibility and is attached at its one end to the high voltage tower (2*b*). The plug boot 10 is installed on a main body of the internal combustion engine by being inserted into the bent plug hole. The plug boot (10) has a thin wall part (10*a*) of a thin thickness formed at a location facing in opposition to a bent portion of the plug hole.

5 Claims, 5 Drawing Sheets

IGNITION COIL APPARATUS FOR INTERNAL COMBUSTION ENGINE

BACKGROUND OF THE INVENTION

1. Field of the Invention

The present invention relates to an ignition coil apparatus for an internal combustion engine in which a plug boot is installed on a main body of the internal combustion engine by being inserted into a bent plug hole.

2. Description of the Related Art

In the past, there has been known an internal combustion engine in which a plug hole is bent at its intermediate portion due to the complication of a cylinder head upper structure, the compact formation of a cylinder head and combustion chambers, and the adoption of a structure to arrange a multitude of spark plugs in a single cylinder to fire a mixture therein.

When an ignition coil apparatus for an internal combustion engine (hereinafter abbreviated as an "ignition coil") is installed on a main body of the internal combustion engine by inserting a plug boot into such a bent plug hole, for the purpose of preventing a reduction in the insertability or insertion property of the plug boot, for example, an ignition coil as described in a first patent document (Japanese patent application laid-open No. H5-52175) employs a bendable coil spring that is arranged between a first metal fitting and a second metal fitting in the flexible plug boot so as to bend an intermediate portion thereof.

However, in the ignition coil described in the above-mentioned first patent document, provision is required for the first metal fitting, the second metal fitting and the coil spring so as to bend the intermediate portion of the plug boot, thus posing a problem that the number of component parts required is increased and the production cost becomes high.

In addition, in the ignition coil having the plug boot molded with its intermediate portion being bent, there is also a problem that molding processing of the bent hollow plug boot is difficult.

SUMMARY OF THE INVENTION

Accordingly, the present invention is intended to obviate the problems as referred to above, and has for its object to obtain an ignition coil apparatus for an internal combustion engine which is inexpensive, simple in structure, and does not impair insertability upon insertion into a bent plug hole.

According to one aspect of the present invention, there is provided an ignition coil apparatus for an internal combustion engine which includes: a high voltage tower that holds a high voltage terminal in its interior, and an electrically insulating and flexible plug boot of a cylindrical shape that has one end attached to the high voltage tower, the plug boot being installed on a main body of the internal combustion engine by being inserted into a bent plug hole. The plug boot has a thin wall part of a thin thickness formed at a location facing in opposition to a bent portion of the plug hole.

According to another aspect of the present invention, there is provided an ignition coil apparatus for an internal combustion engine which includes: a high voltage tower that holds a high voltage terminal in its interior, and an electrically insulating plug boot of a cylindrical shape that has one end attached to the high voltage tower, the plug boot being installed on a main body of the internal combustion engine by being inserted into a bent plug hole. The plug boot is provided with a cylindrical sleeve, and a flexible and cylindrical cap that has one end fitted over the high voltage tower, and the other end fitted over the sleeve spaced from a tip end surface of the high voltage tower with a gap therebetween. The gap faces in opposition to a bent portion of the plug hole.

According to an ignition coil apparatus for an internal combustion engine of the present invention, the apparatus can be produced at low cost with a simple structure, and can be inserted into a bent plug hole without impairing insertability thereof.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
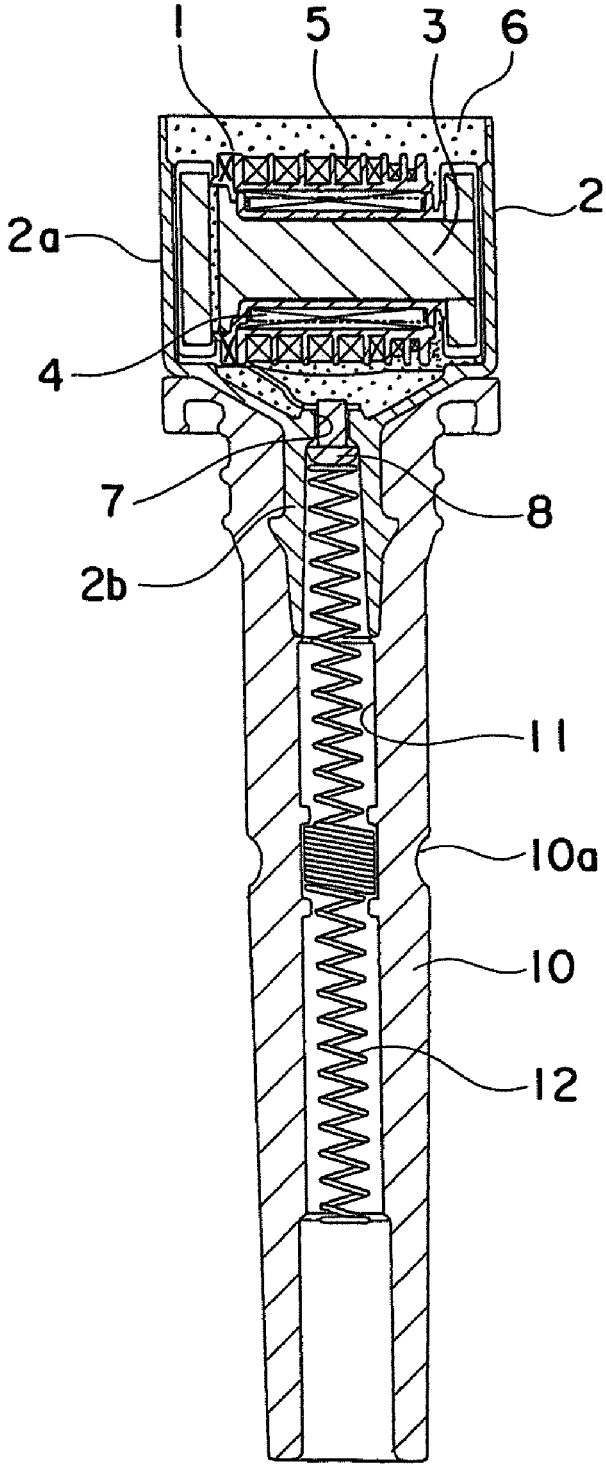
FIG. 1 is a cross sectional front elevational view showing an ignition coil apparatus for an internal combustion engine according to a first embodiment of the present invention.

Now, preferred embodiments of the present invention will be described in detail while referring to the accompanying drawings. Throughout individual figures, the same or corresponding members or parts are identified by the same reference numerals and characters.

Embodiment 1

FIG. 1 is a cross sectional front elevational view that shows an ignition coil apparatus for an internal combustion engine (hereinafter abbreviated as an ignition coil) according to a first embodiment of the present invention.

This ignition coil has a transformer 1 received in a case 2. The transformer 1 has an iron core 3 that is formed of a plurality of thin steel plates laminated one over another, and a primary winding 4 and a secondary winding 5 that are wound around the iron core 3.

The case 2 is composed of a case main body 2*a* that receives the transformer 1 electrically insulated and fixedly attached thereto by an insulating resin 6, and a high voltage tower 2*b* that is formed integrally with the case main body 2*a* and has an opening portion 7. The opening portion 7 of the high voltage tower 2*b* is plugged or closed with a high-voltage terminal 8.

A flexible plug boot 10 made of rubber is fitted onto the high voltage tower 2*b* of the case 2. The plug boot 10 has a through hole 11 formed therethrough along the central axis thereof. A spring 12, being a relay member electrically connected to a spark plug (not shown), is arranged in the interior of the high voltage tower 2*b* and in the through hole 11 so as to urge the spark plug.

The plug boot 10 has a thin wall part 10*a* formed in an intermediate portion of an outer peripheral surface thereof over its entire circumference in such a manner that it is bent around the thin wall part 10*a* with respect to a force acting on the plug boot 10 in a diametral direction thereof. The position of this thin wall part 10*a* corresponds to the position of a bent portion of the plug hole at the intermediate portion thereof when the plug boot 10 is inserted into the plug hole.

In this ignition coil, an electric signal arithmetically processed by an engine control unit (not shown) is sent to an igniter (not shown) through a connector (not shown). Thereafter, an excitation current to the primary winding 4 is controlled by the igniter, so that a high voltage is impressed to the high voltage terminal 8 to cause a discharge in a gap portion of the spark plug.

As described in the foregoing, according to the ignition coil of this embodiment, when the ignition coil is installed on the main body of the internal combustion engine formed with the plug hole bent at the bent portion of the intermediate portion thereof, the plug boot 10 is inserted into the plug hole, during which when a tip end portion of the plug boot 10 reaches the bent portion, the plug boot 10 is thereafter bent at its thin wall part 10*a*, so the inserting operation of the plug boot 10 can be carried out with an inexpensive and simple structure without impairing insertability thereof.

Embodiment 2

Figure 2:
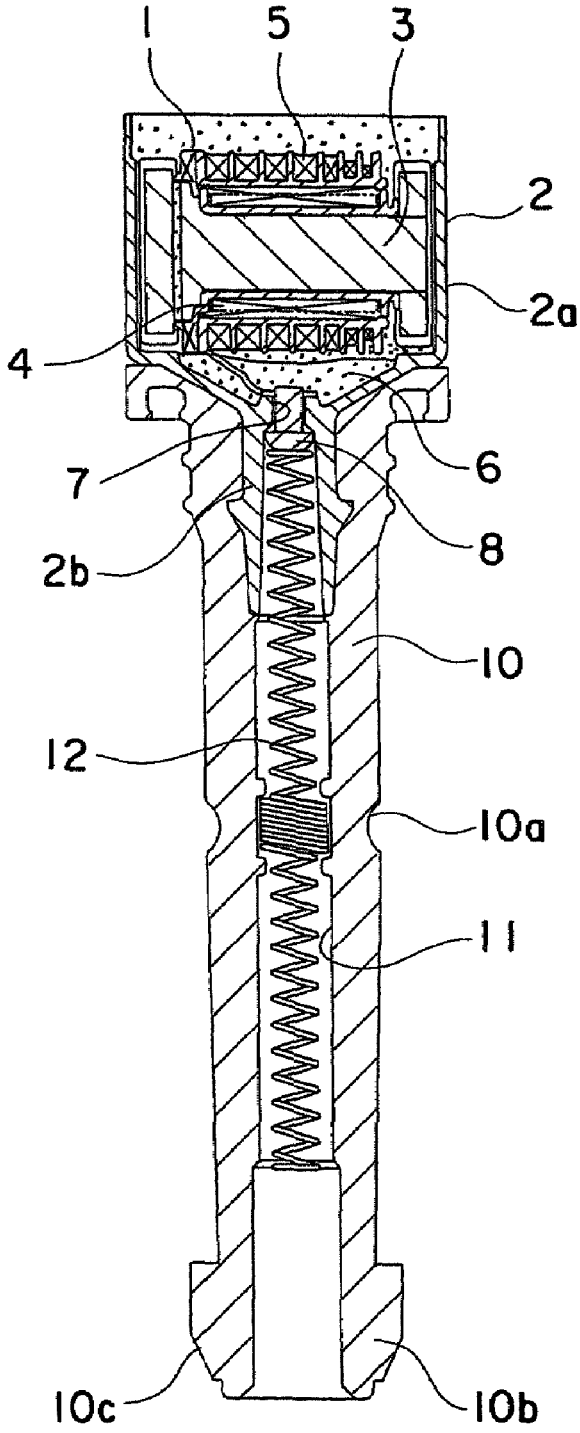
FIG. 2 is a cross sectional front elevational view showing an ignition coil apparatus for an internal combustion engine according to a second embodiment of the present invention.
Figure 3:
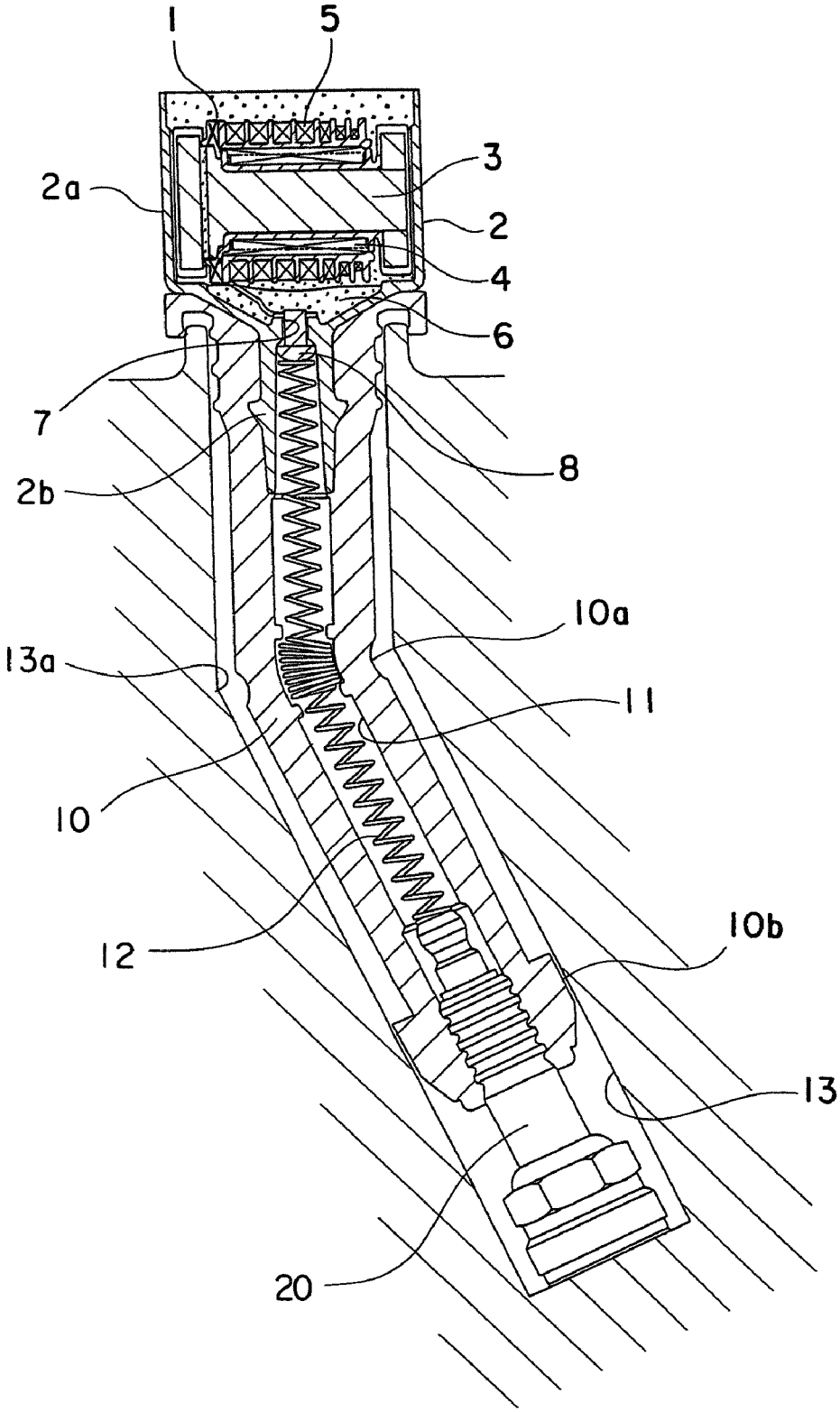
FIG. 3 is a cross sectional front elevational view showing a mode of use of the ignition coil apparatus for an internal combustion engine shown in FIG. 2.

FIG. 2 is a cross sectional front elevational view that shows an ignition coil according to a second embodiment of the present invention. FIG. 3 is a cross sectional front elevational view that shows a mode of use of the ignition coil shown in FIG. 2.

In this second embodiment of the present invention, the plug boot 10 is formed at its tip end with a plurality of guard portions 10*b* which protrude in diametral directions and are arranged at equal intervals in a circumferential direction. Each of the guard portions 10*b* is formed at its tip end with a taper surface 10*c* having an angle of inclination equal to the bending angle in the bent portion 13*a* of the intermediate portion of the plug hole 13. The construction of this second embodiment other than the above is similar to that of the first embodiment.

In the second embodiment of the present invention, as shown in FIG. 3, when the plug boot 10 is inserted over the spark plug 20 installed in the bent plug hole 13, the guard portion 10*b* having the taper surface 10*c* acts as a guide for the plug boot 10, so that the plug boot 10 can be easily bent in accordance with the bending angle of the bent portion 13*a* of the plug hole 13.

In addition, there is almost no gap between an inner peripheral surface of the plug hole 13 and an outer peripheral surface of the guard portion 10*b*, so the central axis of the plug boot 10 and the central axis of the spark plug 20 easily coincide with each other, and the spark plug 20 can be inserted into the plug boot 10 in an easy and reliable manner.

Embodiment 3

Figure 4:
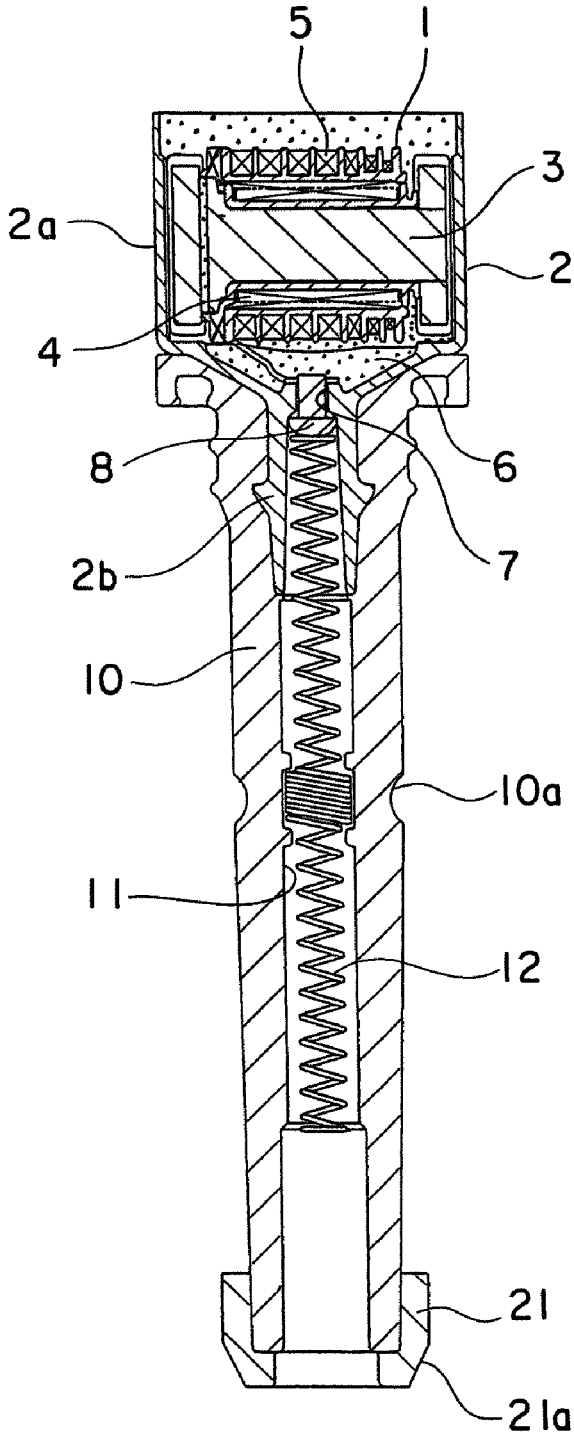
FIG. 4 is a cross sectional front elevational view showing an ignition coil apparatus for an internal combustion engine according to a third embodiment of the present invention.

FIG. 4 is a cross sectional front elevational view that shows an ignition coil according to a third embodiment of the present invention.

In this third embodiment of the present invention, a hard and sliding guard member 21 is fitted over the tip end portion of the plug boot 10. The guard member 21 made of resin is formed at its tip end with a taper surface 21*a* chamfered at an angle equal to the bending angle of the bent portion 13*a* of the plug hole 13. The construction of this third embodiment other than the above is similar to that of the first embodiment.

In this third embodiment of the present invention, when the spark plug 20 installed in the bent plug hole 13 is inserted into the plug boot 10, the guard member 21 having the taper surface 21*a* acts as a guide for the plug boot 10, so that the plug boot 10 can be easily bent in accordance with the bending angle of the bent portion 13*a* of the plug hole 13.

In addition, there is almost no gap between the inner peripheral surface of the plug hole 13 and the outer peripheral surface of the guard portion 10*b*, so the central axis of the plug boot 10 and the central axis of the spark plug 20 easily coincide with each other, and the spark plug 20 can be inserted into the plug boot 10 in an easy and reliable manner.

Also, the guard member 21 is composed of a sliding material which is made of resin with a sliding or slippery surface, so the insertability of the plug boot 10 can be further improved in comparison with that of the second embodiment.

Moreover, the guard member 21 is fitted over the tip end portion of the plug boot 10, so that it serves to prevent the wear and degradation of the tip end portion of the plug boot 10 at the time when the plug boot 10 is inserted into the bent hole 13.

Embodiment 4.

Figure 5:
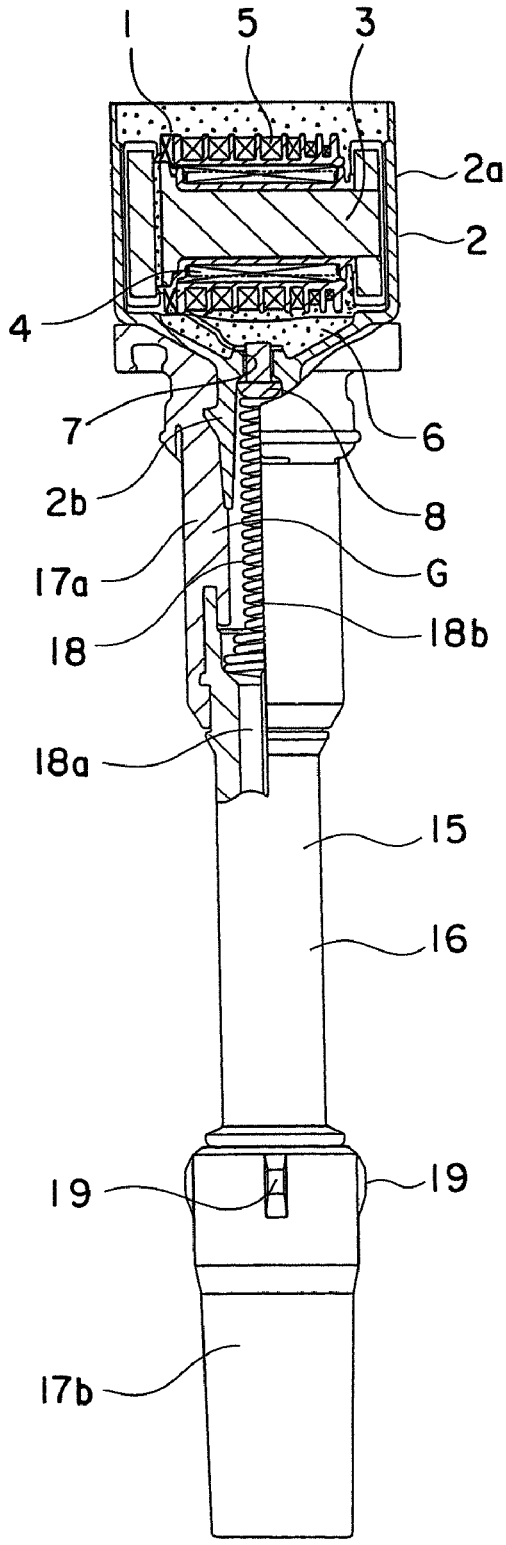
FIG. 5 is a cross sectional front elevational view showing an ignition coil apparatus for an internal combustion engine according to a fourth embodiment of the present invention.

FIG. 5 is a cross sectional front elevational view that shows an ignition coil according to a fourth embodiment of the present invention.

In this fourth embodiment of the present invention, a plug boot 15 comprises a sleeve 16 made of resin, a first cylindrical cap 17*a* which is made of rubber has its one end fitted over one end portion of the sleeve 16, and a second cylindrical cap 17*b* which is made of rubber and fitted over the other end of the sleeve 16. The first cap 17*a* has the other end thereof fitted over the high voltage tower 2*b*. The high voltage tower 2*b* has a tip end surface thereof spaced from an end face of the sleeve 16 with a gap or clearance G formed therebetween. The second cap 17*b* is provided with a plurality of guard portions 19 that are arranged at equal intervals in a circumferential direction so as to protrude in diametral directions.

In the interior of the plug boot 15, there is arranged a relay member 18, which is electrically connected to the spark plug 20, in a manner to urge the spark plug 20. This relay member 18 is composed of a rod-shaped connecting portion 18*a* and a pair of spring portions 18*b* connected with the opposite ends of the connecting portion 18*a*.

When the plug boot 15 is inserted into the plug hole 13, the gap G faces in opposition to the bent portion 13*a* of the intermediate portion of the plug hole 13. The construction of this fourth embodiment other than the above is similar to that of the first embodiment.

In this fourth embodiment of the present invention, in case where the ignition coil is installed on the main body of the internal combustion engine with the bent plug hole 13 being bent at the bent portion 13*a* of the intermediate portion thereof, the plug boot 15 is inserted into the plug hole 13, and when the tip end portion of the plug boot 15 reaches the bent portion 13*a* during insertion thereof, the flexible first cap 17*a* is caused to bend in the gap G, so the inserting operation of the plug boot 15 can be performed with an inexpensive and easy structure without impairing insertability thereof.

In addition, there exists substantially no gap between the inner peripheral surface of the plug hole 13 and the outer peripheral surface of the guard portion 19, so the central axis of the plug boot 15 and the central axis of the spark plug 20 can be easily coincided with each other, and the spark plug 20 can be easily inserted into second cap 17*b* of the plug boot 15 in a reliable manner.

Here, note that the plug boot 15 may be formed at its tip end portion with a guard portion which has a tip end surface chamfered at an angle equal to the bending angle of the bent portion 13*a* of the plug hole 13.

Also, the plug boot 15 may be provided at its tip end portion with a hard and sliding guard member which has a tip end surface chamfered at an angle equal to the bending angle of the bent portion 13*a* of the plug hole 13.

In the ignition coil of the above-mentioned first embodiment, the spring 12 is used as a relay member for electrically connecting the high voltage terminal 8 and the spark plug 20 to each other, and in the ignition coil of the second embodiment, the relay member 18 is composed of the connecting portion 18*a* and the spring portions 18*b*, but there may be used other electrically conductive members such as, for example, a leaf or flat spring, electrically conductive rubber, etc. In addition, an electrically conductive pipe may be used between a location of the relay member facing in opposition to the bent portion 13*a* and the spark plug 20 so as to raise rigidity therebetween and improve the insertability of the spark plug 20.

While the invention has been described in terms of preferred embodiments, those skilled in the art will recognize that the invention can be practiced with modifications within the spirit and scope of the appended claims.

What is claimed is:

1. An ignition coil apparatus for an internal combustion engine including a high voltage tower that holds a high voltage terminal in its interior, and an electrically insulating and flexible plug boot of a cylindrical shape that has one end attached to said high voltage tower, said plug boot being installed on a main body of said internal combustion engine by being inserted into a bent plug hole, wherein said plug boot has a thin wall part of a thin thickness formed at a location facing in opposition to a bent portion of said plug hole, wherein said plug boot is provided at its one end with a hard and sliding guard member, and said hard and sliding guard member has a tip end surface chamfered at an angle equal to a bending angle of said bent portion of said plug hole, and wherein said hard and sliding guard member is inserted onto the one end of said plug boot.

2. The ignition coil apparatus for an internal combustion engine as set forth in claim 1, wherein said thin wall part is arc-shaped in cross-section.

3. An ignition coil apparatus for an internal combustion engine including a high voltage tower that holds a high voltage terminal in its interior, and an electrically insulating plug boot of a cylindrical shape that has one end attached to said high voltage tower, said plug boot being installed on a main body of said internal combustion engine by being inserted into a bent plug hole, wherein said plug boot is provided with a cylindrical sleeve, and a flexible cylindrical cap that has one end fitted over said high voltage tower, and the other end fitted over said sleeve spaced from a tip end surface of said high voltage tower with a gap therebetween, and wherein said gap faces in opposition to a bent portion of said plug hole.

4. The ignition coil apparatus for an internal combustion engine as set forth in claim 3, wherein said plug boot is provided at its one end with a hard and sliding guard member, and said guard member has a tip end surface chamfered at an angle equal to a bending angle of said bent portion of said plug hole.

5. The ignition coil apparatus for an internal combustion engine as set forth in claim 4, wherein said hard and sliding member is inserted onto the one end of said plug boot.

* * * * *